United States Patent [19]

Sullivan, Jr. et al.

[11] 3,946,230

[45] Mar. 23, 1976

[54] COPY METHOD UTILIZING SINGLE RADIANT RAY PATH FOR IMAGING AND TRANSFIXING

[75] Inventors: William A. Sullivan, Jr., Webster, N.Y.; Roger H. Eichorn, deceased, late of Rochester, N.Y., by Lincoln First Bank of Rochester, executor

[73] Assignee: Xerox Corporation, Stamford, Conn.

[22] Filed: Dec. 27, 1973

[21] Appl. No.: 428,976

[52] U.S. Cl. ..... 250/316; 250/319

[51] Int. Cl.[2] ..... B41M 5/00; G03C 5/16

[58] Field of Search ..... 250/316, 317, 318, 319

[56] References Cited

UNITED STATES PATENTS

| | | | |
|---|---|---|---|
| 3,081,699 | 3/1963 | Gulko | 250/318 |
| 3,260,612 | 7/1966 | Dulmage | 250/317 |

*Primary Examiner*—Craig E. Church

[57] ABSTRACT

An original and a heat sensitive member are inserted as a sandwich into a copying machine and fed past a combined imaging and transfixing or fusing station where radiation is applied to the sandwich to thermally impart a latent image of the original to the heat sensitive member. Thereafter, the original is separated from the heat sensitive member and ejected from the machine. The heat sensitive member on the other hand, continues onwardly to a developing station where toner particles are applied to develop the latent image. Next, the heat sensitive member loops back towards the imaging and transfixing station, and a copy medium is brought into engagement with the developed image. The copy medium and the heat sensitive member are then passed into the imaging and transfixing or fusing station. There, the developed image is transfixed (transferred and fused) to the copy medium by applying heat to the sandwich subsequently the sandwich is discharged from the machine, and the operator then separates the copy medium from the heat sensitive member to obtain his copy. Alternatively, the transfixing step may be omitted in favor of fusing the developed image directly to the heat sensitive member at the imaging and transfixing or fusing station.

13 Claims, 2 Drawing Figures

COPY METHOD UTILIZING SINGLE RADIANT RAY PATH FOR IMAGING AND TRANSFIXING

DESCRIPTION OF INVENTION

Figure 1:
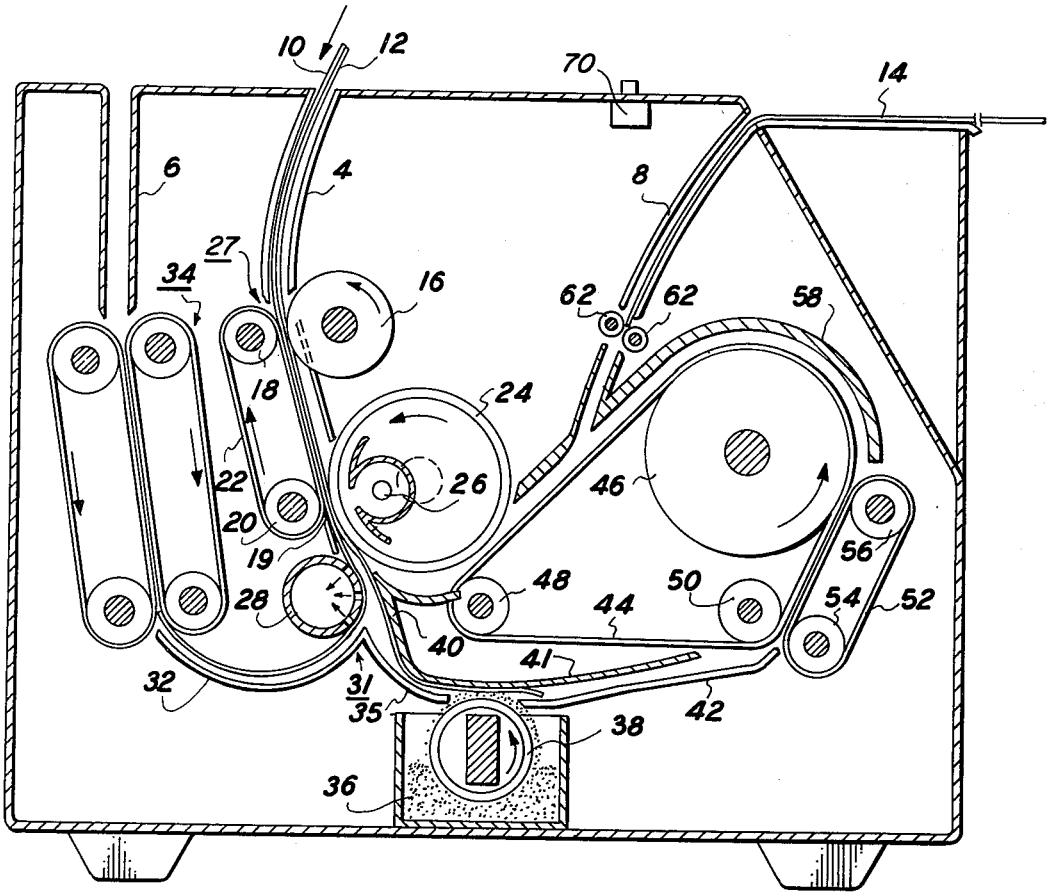

It is an object of this invention to provide a thermographic copying apparatus which has simple controls and a minimum number of parts.

It is a further object of this invention to provide a machine which not only has those characteristics, but which also is capable of producing a quality copy in a minimum amount of time.

To carry out these and other objects, the thermographic copier here disclosed relies on the same source of radiant energy and a single energy transmission path for the two fold purpose forming a thermal image of an original on a heat sensitive intermediate member and for transfixing (transferring and fusing) a devloped image from the intermediate to a copy medium or for fusing the devloped image to the heat sensitive member. Hence, the controls may be simplified and parts, which are usually duplicated when two radiant sources are used, are eliminated. Obviously this allows a more compact unit to be constructed. Furthermore, the system design is flexible since the transfixing or fusing function takes place after the imaging and development functions with the result that the design is not constrained by the transfixing or fusing function being dependent upon the controls applied to the imaging and development functions or vice versa.

Figure 2:
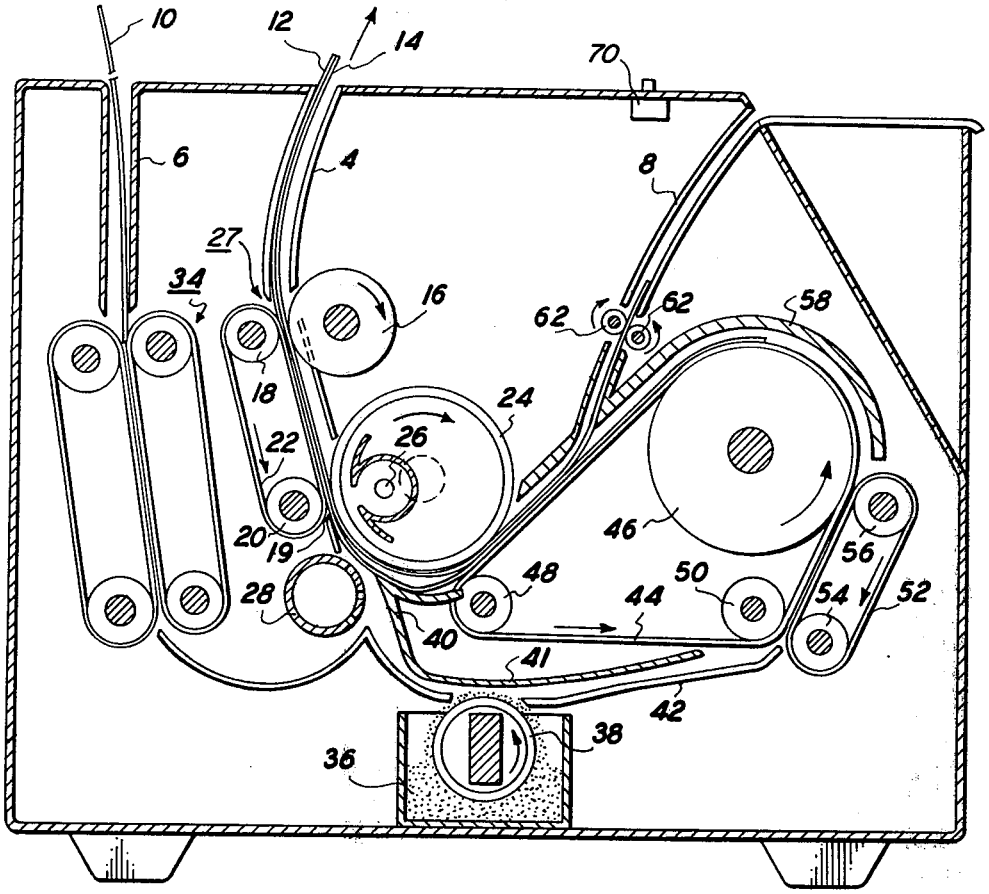

Other objects of the invention will become apparent from the following description with reference to the drawing wherein:

FIG. 1 is a schematic view of a copying machine showing an original and a heat sensitive member passing through an imaging and transfixing station; and FIG. 2 is a schematic view similar to FIG. 1, except that the process has advanced to the point at which a developed heat sensitive member and a copy medium are passed through the imaging and transfixing station to effect transfer of the developed image to the copy medium.

Referring to the drawings, the copying apparatus therein has three sets of guide moldings 4, 6 and 8, which run inwardly from the outer surface of the copier. The molding 4 serves as an inlet guide for a sandwich containing an original sheet 10 and a heat sensitive sheet 12 and an outlet guide for a sandwich containing the heat sensitive sheet 12 and a copy sheet 14. The molding 6 serves as an outlet guide for the original sheet 10, and the molding 8 serves as an inlet guide for the copy sheet 14.

The heat sensitive sheet 12 comprises a support and a heat sensitive coating. For example, the support may be an organic film such as a polyester film, cellulose acetate or triacetate film. The coating, on the other hand, is a delayed tack adhesive which is normally hard and non-tacky at room temperature, but which, upon being activated by heat to a tacky condition and subsequently cooled to room temperature, thereafter remains tacky for considerable periods of time varying from at least 30 seconds to several days or more depending upon the particular composition involved. Such delayed tack coatings are well known and can be a mixture of discrete particles or resin, such as indene resin or esterified resin, and discrete particles of crystalling plasticizer, such as diphenyl phthalate or N-cyclohexyl paratoluene sulfonamide. The particles are bound together into the supporting film by a binder such as styrene-butadiene copolymer. Generally speaking, the crystalline plasticizer component of the mixture is in excess of the resin component.

An idler roll 16 and a conveyor mechanism comprising a drive roll 18 and an idler roll 20 and a conveyor belt 22 are located at the inner end of the guide 4. A driven radiation transparent quartz cylinder 24 is arranged on the frame of the copying apparatus to rotate in opposite directions, and located within the cylinder 24 is a radiant source, such as an incandescent lamp 26. The idler roll 16 is arranged to contact the belt 22, thereby forming a nip 27 therebetween for receiving and forwarding the sandwich of the original sheet 10 and the heat sensitive sheet 12. The cylinder 24 is arranged to contact the belt 22 at the idler roll 20 whereby a slight pressure is applied to the sandwich as it passes through a nip 19 between the cylinder 24 and the roll 20. Located downstream of the idler roll 20 is a vacuum source 28 which serves to separate the original from the heat sensitive member. Next, there is guide member 31 which has one portion 32 for guiding the original sheet 10 to a conveyor mechanism 34 which grabs the original sheet and conveys it through the guide 6 out of the machine. Concurrently, another portion 35 of the guide 31 directs the heat sensitive member 12 to a developed station which comprises a housing containing ferromagnetic toner particles 36 and a magnetic brush 38.

The toner particles comprise iron oxide particles mixed with thermoplastic particles which are pigmented with carbon black or other radiation absorbing dyes or pigments. The magnetic developer brush 38 is rotatably mounted on the housing so that successive segments of its surface advance through a supply of toner particles 36 and then bring the toner particles into engagement with the heat sensitive member 12 to develop the latent image. A guide member 40 has a portion 41 which is spaced from the outer surface of the developer brush 38 a distance approximately equal to the thickness of the heat sensitive member 12 to ensure that the toner particles 36 are brought into engagement with the heat sensitive member as it passes through the developer station. Next, there is a guide 42 for leading the heat sensitive member to a conveyor mechanism comprising a belt 44 which is trained around a drive roll 46 and a pair of idler rolls 48 and 50. Also at the downstream end of the guide 42 there is a conveyor mechanism which comprises another belt 52 which is trained around a drive roll 54 and an idler roll 56. The belt 52 works in conjunction with the belt 44 to pull the heat sensitive sheet 10 past the developer station and to advance it forwardly around a path reversal guide 58. There the leading edge of the heat sensitive sheet engages a portion 60 of the guide 40 so that the heat sensitive sheet 12 is directed back to the nip 19 between the cylinder roll 24 and the belt 22.

Located within the copy guide 8 are a pair of nip rolls 62 which are located to grip the leading edge of the copy sheet 14 upon insertion thereof into the guide 8. At the proper time, the nip rolls 62 forward the copy sheet 14 through the downstream portion of the guide 8 into the path between the guide 58 and the belt 44 where the leading edges of the heat sensitive sheet 12 and the copy sheet 14 become aligned and the sheets form a sandwich which is conveyed past guide 60 to the nip 19 between the cylinder 24 and the belt 22. The sandwich continues past the lamp 26 and is finally fed out of the copying machine via guide 4.

A reversible motor (not shown) is operably connected to drive the drive roll 18 and the cylinder 24 in opposite directions. A separate motor (not shown) is operably connected to drive the conveyor mechanism 34, the magnetic brush 38 and the drive rolls 54 and 56. These motors are all operated by a control system (not shown) which operates the machine as follows:

Referring to FIG. 1, the heat sensitive sheet 12 and an original sheet 10 bearing an image thereon are placed together and then inserted as a sandwich into the guide passage 4, which directs them to the nip 27 between the rolls 16 and 18. A copy sheet 14 is inserted into the guide 8, which directs it to the nip formed by rolls 62. A switch 70 is actuated to start the control mechanism whereupon the idler roll 16 and the conveyor belt 22 grab the leading edge of the sandwich and move the same to the nip 19 between the cylinder 24 and the belt 22. At this time, the lamp 26 is energized and the sandwich is exposed thereto as it travels therepast to create a tacky image on the heat sensitive member 12 corresponding to the image on the original sheet. The sandwich then advances downstream where the original and the heat sensitive sheet are separated by the vacuum source 28. The original 10 continues around the guide 32 to the conveyor mechanism 34 and out of the machine through the guide 6 while the heat sensitive member continues to the developer station. There, the magnetic brush 38 dusts the tacky image with toner particles 36 to develop the same. The control mechanism contains cams to turn off the lamp 26 after the trailing edge of the sandwich passes through the nip 19 between the cylinder 24 and the belt 22.

Referring to FIG. 2, the developed heat sensitive sheet 12 continues beyond the developer station and around the guide 58 whereupon the control system actuates the nip rolls 62 to bring the leading edges of the copy sheet 14 and the heat sensitive sheet 12 into aligned engagement. The sandwich thus formed is fed by the belts 52 and 44 and the nip rolls 62 back to the imaging and transfixing station. At the same time, the control mechanism has cut off the vacuum supply to separator 18 and has actuated the motor driving the drive roll 18 and the cylinder 24 to reverse the direction of rotation thereof hence, the leading edge of the copy sheet 14, heat sensitive member 12 sandwich reaching the nip 19, and the sandwich is then pulled past the lamp 26. The lamp 26 is energized just prior to the sandwich reaching the nip 19. The sandwich is heated until a substantial portion of the toner particles become transfixed (transferred and fixed) to the copy sheet to provide a reproduction of the original image. The image transfers under the influence of the pressure between the sheets effected by the pressure contact between the rolls 20 and 24 combined with a corresponding proper temperature. The sandwich is finally fed out of the machine through the guide 4 by the belt 22. The control system has cams which turn off all motors and the lamp 26 after the trailing edge of the heat sensitive sheet, copy sheet sandwich is passed between the belt 22 and the idler roll 16. The operator of the machine then removes the sandwich from the machine and separates the copy sheet 14 from the heat sensitive sheet 12 to obtain his copy of the original.

Rather than transfer the developed image, the developed image may be fused onto the intermediate. In that event, the belt 22 must comprise a material to which melted toner particles will not stick. Alternatively, a release sheet could be substituted for the copy sheet 14, in which case it is a heat sensitive sheet, release sheet sandwich that is fed past the lamp 26. In that embodiment, the release sheet will be of a material to which the toner particles will not stick.

Rather than inserting a copy sheet into a slot in the machine, an automatic paper feeder could be provided.

The control system and the components thereof for operating the machine in the manner described are all well known and well within the grasp of one having ordinary skill in the art and therefore have not been shown.

Since the imaging and developing functions are separate from the image transfer function, the intensity of the lamp 26 and the speed of travel of the sheet 12 independently optomized for the imaging and transfixing or fusing process.

From the above, it can be seen that the described machine eliminates parts, which are usually duplicated when two lamps are used at different stations, and permits of a relatively straight forward control system.

What is claimed is:

1. A method for thermographically reproducing a copy of an image borne by an original; said method comprising the steps of:

forming a sandwich containing a heat sensitive member and said original;

advancing the sandwich past a radiant source to thermally impart said image to said heat sensitive member in response to radiant energy supplied by said source via a predetermined path;

separating the original from said heat sensitive member;

advancing the heat sensitive member through a development station to develop the image imparted thereto;

looping the heat sensitive member back toward said radiant source while retaining a predetermined edge of said heat sensitive member as its leading edge; and advancing the heat sensitive member past said radiant source for a second time to expose the developed image thereon to radiant energy supplied by said source via said predetermined path.

2. The method of claim 1 wherein said heat sensitive member becomes tacky in an image configuration when said sandwich is exposed to said radiant energy.

3. A method as recited in claim 2 wherein the tacky image imparted to the heat sensitive member is developed with toner particles.

4. The method as recited in claim 2 wherein the heat sensitive member is advanced past said radiant source for the second time to fuse the developed image to said heat sensitive member.

5. The method as recited in claim 2 wherein the development of said image is followed by the additional step of bringing a copy medium into engagement with the developed image, and the exposure of said developed image to said radiant energy is carried on while said copy medium is in engagement with said image, whereby said image is transfixed on said copy medium.

6. A method as recited in claim 5 comprising the additional step of discharging said heat sensitive member and said copy medium after the transfixing of the developed image onto the copy medium.

7. A method as recited in claim 2 wherein the heat sensitive member is looped back toward said radiant source after passing through the development station.

8. A thermographic copier for reproducing a copy of an image borne by an original, said copier comprising the combination of a heating station, means for feeding a sandwich containing said original in registration with a heat sensitive member through said heating station to thermally impart said image to said heat sensitive member, a development station, means for advancing the imaged heat sensitive member from said heating station to and through said development station and for looping said member back toward said heating station while retaining a predetermined edge of said member as its leading edge, means at said development station for developing the image on said heat sensitive member as said member is advanced therethrough, and means for feeding the heat sensitive member with the developed image back through said heating station to produce said copy.

9. The copier of claim 8 wherein said heat sensitive member becomes tacky in an image configuration as said sandwich is fed through said heating station.

10. The copier of claim 9 wherein said heating station includes a source of radiant energy, and said heat sensitive member is heated each time it is fed through said heating station by the radiant energy emanating from said source along a predetermined path.

11. The copier of claim 10 further including means for bringing a copy medium into contact with the developed image on said heat sensitive member, said heat sensitive member being fed back through said heating station while said copy medium is engaged therewith, whereby the developed image is transfixed onto the copy medium at the heating station.

12. The copier of claim 10 further including means for automatically registering said original with said heat sensitive member to form said sandwich.

13. The copier of claim 10 wherein the developed image is fused to said heat sensitive member as that member is fed back through said heating station.

* * * * *